US006408826B2

(12) United States Patent
Asada et al.

(10) Patent No.: US 6,408,826 B2
(45) **Date of Patent: *Jun. 25, 2002**

(54) COMMON RAIL AND METHOD OF MANUFACTURING THE SAME

(75) Inventors: Kikuo Asada, Mishima; Masayoshi Usui, Numazu; Eiji Watanabe, Tagata-gun; Kazunori Takikawa, Numazu; Ryuichi Kusanagi, Numazu, all of (JP)

(73) Assignee: Usui Kokusai Sangyo Kaisha Limited (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 23 days.

This patent is subject to a terminal disclaimer.

(21) Appl. No.: 09/033,541

(22) Filed: Mar. 20, 1998

(30) Foreign Application Priority Data

Mar. 3, 1997 (JP) ..... 9-063845

(51) Int. Cl.[7] ..... F02M 55/02

(52) U.S. Cl. ..... 123/468; 123/456; 285/374

(58) Field of Search ..... 123/456, 468, 123/469, 470; 285/374, 332.2

(56) References Cited

U.S. PATENT DOCUMENTS 1,246,456 A 11/1917 Parpert
1,264,854 A 4/1918 Possons (List continued on next page.)

FOREIGN PATENT DOCUMENTS

EP 0507191 * 10/1992 ..... 123/468

(List continued on next page.)

*Primary Examiner*—Carl S. Miller
(74) *Attorney, Agent, or Firm*—Anthony J. Casella; Gerald E. Hespos

(57) ABSTRACT

There is provided a common rail which can effectively restrict a generation of a stress in a lower end inner peripheral edge portion of a branch hole and can improve an internal pressure fatigue strength in a branch pipe connecting portion, so that a secure and stable function can be obtained by having an excellent durability and preventing a fluid leakage due to a generation of the crack generation and a method of manufacturing a common rail in which a pressure application process by the press is only added to a normal manufacturing process, no complex equipment is required, a common rail having a high quality can be manufactured by a low cost without generating problems that an equipment cost is increased by an increase of the process and a productivity is reduced. In the method of the invention, there is provided a method of manufacturing a common rail comprising at least one branch hole provided in an axial peripheral wall portion of a main pipe rail having a communication passage inside an axial core, a pressure receiving seat surface communicating with a branch pipe having a communication passage communicating with the communication passage in a peripheral surface portion of the branch hole and open to an outer portion, thereby bringing a pressing seat surface portion constituted by a connection head portion disposed in an end portion of the branch pipe into contact and engaging therewith, and a joint metal fitting surrounding an outer peripheral portion of the main pipe rail and a nut previously assembled in the branch pipe end which are meshed with each other so as to be pressed under a neck portion of the connection head portion, thereby being fastened and connected, wherein a pressing force is applied to the main pipe rail near the branch hole from an outer portion to a diametrical direction by a press method, thereby generating a compression residual stress at a portion near the open end portion of the communication passage of the main pipe rail in the branch hole.

4 Claims, 10 Drawing Sheets

U.S. PATENT DOCUMENTS

| | | | | | |
|---|---|---|---|---|---|
| 1,476,756 | A | | 12/1923 | Junkers | |
| 1,519,010 | A | | 12/1924 | Reznor | |
| 1,841,879 | A | | 1/1932 | Croxford | |
| 2,041,209 | A | | 5/1936 | Ridley | |
| 2,426,106 | A | | 8/1947 | Kinley | |
| 2,859,870 | A | | 11/1958 | Hitz | |
| 3,068,029 | A | | 12/1962 | Schwartz | |
| 3,082,850 | A | | 3/1963 | Weening | |
| 3,094,137 | A | | 6/1963 | Burke | |
| 3,259,003 | A | | 7/1966 | Griffin | |
| 3,277,683 | A | | 10/1966 | Knoblock | |
| 3,783,842 | A | * | 1/1974 | Ruhn | 123/469 |
| 3,845,748 | A | * | 11/1974 | Eisenberg | 123/469 |
| 4,129,028 | A | | 12/1978 | Leftheris et al. | |
| 4,364,406 | A | | 12/1982 | Bohlin | |
| 4,399,829 | A | | 8/1983 | Schuler | |
| 4,445,713 | A | * | 5/1984 | Gruning | 123/469 |
| 4,680,845 | A | | 7/1987 | Miller | |
| 4,741,081 | A | | 5/1988 | Redman | |
| 4,832,376 | A | | 5/1989 | Sugao | |
| 4,893,601 | A | * | 1/1990 | Sugao | 123/469 |
| 4,900,180 | A | | 2/1990 | Takikawa | |
| 4,979,295 | A | | 12/1990 | Stagni et al. | |
| 5,072,710 | A | | 12/1991 | Washizu | |
| 5,120,084 | A | | 6/1992 | Hashimoto | |
| 5,136,999 | A | | 8/1992 | Bassler et al. | |
| 5,143,410 | A | | 9/1992 | Takikawa | |
| 5,169,182 | A | | 12/1992 | Hashimoto | |
| 5,172,939 | A | | 12/1992 | Hashimoto | |
| 5,192,026 | A | | 3/1993 | Rix et al. | |
| 5,265,456 | A | | 11/1993 | Kennedy et al. | |
| 5,616,037 | A | * | 4/1997 | Lorraine | 123/456 |
| 5,667,255 | A | | 9/1997 | Kato | |
| 5,775,302 | A | * | 7/1998 | Guido | 123/468 |
| 5,887,910 | A | | 3/1999 | Usui | |
| 5,957,507 | A | | 9/1999 | Asada | |
| 5,979,945 | A | | 11/1999 | Hitachi et al. | |
| 5,992,904 | A | | 11/1999 | Hitachi et al. | |
| 6,050,611 | A | | 4/2000 | Asada | |

FOREIGN PATENT DOCUMENTS

| | | | | |
|---|---|---|---|---|
| FR | 806413 | | 12/1936 | |
| GB | 836524 | | 6/1960 | |
| JP | 2-802289 | | 6/1990 | |
| JP | 3-177693 | | 8/1991 | |
| JP | 4-175462 | | 6/1992 | |
| JP | 406042 428 | * | 2/1994 | 123/469 |
| NL | 88663 | | 7/1958 | |

* cited by examiner

COMMON RAIL AND METHOD OF MANUFACTURING THE SAME

BACKGROUND OF THE INVENTION

1. Field of the Invention

The present invention generally relates to a common rail such as a high pressure fuel manifold in an accumulator fuel injection system of a diesel engine or a block rail.

2. Description of the Prior Arts

Conventionally, as thick kind of common rail, for example, as shown in FIG. 11, there has been known a common rail of the type which is structured such that a branch hole 21-2 portion communicating with an inner communication passage 21-1 disposed in a peripheral wall portion of a main pipe rail 21 end constituted by a circular pipe is made a pressure receiving seat surface 21-3 open to an outer direction, and pressing seat surface 22-3 constituted by a connection head portion 22-2 of a branch pipe 22 having a tapering conical shape and enlarged a diameter thereof by buckling is brought into contact and engaged with an end portion by using a joint metal fitting 23 surrounding an outer peripheral portion of the main pipe rail 21 adjacent to the pressure receiving seat surface, thereby fastening and connecting to a screw wall 23-1 portion projecting to the joint metal fitting 23 together with pressing under the connection head portion 22-2 neck by means of an engagement of a fastening nut 24 previously assembled in the branch pipe end. In the drawing, reference numeral 22-1 denotes a flow passage of the branch pipe 22 and reference numeral 25 denotes a sleeve washer.

However, in the case of the common rail of the type that the joint metal fitting type common rail which is structured such that the joint metal fitting 23 is outwardly fitted to the main pipe rail 21 and the nut 24 meshed with the joint metal fitting 23 is fastened and connected, as shown in FIG. 11, a great stress is generated in an inner peripheral edge portion P of a lower end of the branch hole 12-2 due to an axial force applied to the pressure receiving seat surface 21-3 together with the internal pressure of the main pipe rail 21 and the pressing of the connection head portion 22-2 in the branch pipe 22, so that a crack is easily generated with starting from the lower end inner peripheral edge portion P and there is a possibility of inviting a leakage.

SUMMARY OF THE INVENTION

The present invention is made so as to solve the conventional problems mentioned above, and an object of the invention is to provide a common rail which can reduce a maximum tensile stress value generated in an inner peripheral edge portion of a lower end of a branch hole and can improve an internal pressure fatigue strength and a method of manufacturing the same.

In order to achieve the object mentioned above, in accordance with a first aspect of the invention, there is provided a common rail comprising at least one branch hole provided in an axial peripheral wall portion of a main pipe rail having a communication passage inside an axial core, a pressure receiving seat surface communicating with a branch pipe having a communication passage communicating with the communication passage in a peripheral surface portion of the branch hole and open to an outer portion, thereby bringing a pressing seat surface portion constituted by a connection head portion disposed in an end portion of the branch pipe into contact and engaging therewith, and a joint metal fitting surrounding an outer peripheral portion of the main pipe rail and a nut previously assembled in the branch pipe end which are meshed with each other so as to be pressed under a neck portion of the connection head portion, thereby being fastened and connected, in which a compression residual stress is present at a portion near the open end portion of the communication passage of the main pipe rail in the branch hole.

Further, in accordance with a second aspect of the invention, there is provided a method of manufacturing a common rail comprising at least one branch hole provided in an axial peripheral wall portion of a main pipe rail having a communication passage inside an axial core, a pressure receiving seat surface communicating with a branch pipe having a communication passage communicating with the communication passage in a peripheral surface portion of the branch hole and open to an outer portion, thereby bringing a pressing seat surface portion constituted by a connection head portion disposed in an end portion of the branch pipe into contact and engaging therewith, and a joint metal fitting surrounding an outer peripheral portion of the main pipe rail and a nut previously assembled in the branch pipe end which are meshed with each other so as to be pressed under a neck portion of the connection head portion, thereby being fastened and connected, in which a pressing force is applied to the main pipe rail near the branch hole from an outer portion to a diametrical direction, preferably by a press method, thereby generating a compression residual stress at a portion near the open end portion of the communication passage of the main pipe rail in the branch hole. Further, in this case, the branch hole is punched at the same time as the pressing force is applied to the main pipe rail near the branch hole form the outer portion to the diametrical direction by an external pressing method.

Still further, in accordance with a third aspect of the invention, there is provided a method of manufacturing a common rail comprising at least one branch hole provided in an axial peripheral wall portion of a main pipe rail having a communication passage inside an axial core, a pressure receiving seat surface communicating with a branch pipe having a communication passage communicating with the communication passage in a peripheral surface portion of the branch hole and open to an outer portion, thereby bringing a pressing seat surface portion constituted by a connection head portion disposed in an end portion of the branch pipe into contact and engaging therewith, and a joint metal fitting surrounding an outer peripheral portion of the main pipe rail and a nut previously assembled in the branch pipe end which are meshed with each other so as to be pressed under a neck portion of the connection head portion, thereby being fastened and connected, in which a pressing force is applied to an inner peripheral surface of the main pipe rail near the branch hole by an internal pressing method, thereby generating a compression residual stress at a portion near the open end portion of the communication passage of the main pipe rail in the branch hole.

Furthermore, in accordance with a fourth aspect of the invention, there is provided a method of manufacturing a common rail comprising at least one branch hole provided in an axial peripheral wall portion of a main pipe rail having a communication passage inside an axial core, a pressure receiving seat surface communicating with a branch pipe having a communication passage communicating with the communication passage in a peripheral surface portion of the branch hole and open to an outer portion, thereby bringing a pressing seat surface portion constituted by a connection head portion disposed in an end portion of the branch pipe into contact and engaging therewith, and a joint metal fitting surrounding an outer peripheral portion of the main pipe rail and a nut previously assembled in the branch pipe end which are meshed with each other so as to be pressed under a neck portion of the connection head portion, thereby being fastened and connected, in which a pressing force is applied to an inner peripheral surface of the main pipe rail near the branch hole by a pipe expansion method which applies a pressure to a pipe diametrical direction from an inner portion of the main pipe rail, thereby generating a compression residual stress at a portion near the open end portion of the communication passage of the main pipe rail in the branch hole.

Moreover, in accordance with a fifth aspect of the invention, there is provided a method of manufacturing a common rail comprising at least one branch hole provided in an axial peripheral wall portion of a main pipe rail having a communication passage inside an axial core, a pressure receiving seat surface communicating with a branch pipe having a communication passage communicating with the communication passage in a peripheral surface portion of the branch hole and open to an outer portion, thereby bringing a pressing seat surface portion constituted by a connection head portion disposed in an end portion of the branch pipe into contact and engaging therewith, and a joint metal fitting surrounding an outer peripheral portion of the main pipe rail and a nut previously assembled in the branch pipe end which are meshed with each other so as to be pressed under a neck portion of the connection head portion, thereby being fastened and connected, in which after a pressing force is applied to an inner peripheral surface of the main pipe rail, the branch hole is punched.

Further, in accordance with a sixth aspect of the invention, there is provided a method of manufacturing a common rail comprising at least one branch hole provided in an axial peripheral wall portion of a main pipe rail having a communication passage inside an axial core, a pressure receiving seat surface communicating with a branch pipe having a communication passage communicating with the communication passage in a peripheral surface portion of the branch hole and open to an outer portion, thereby bringing a pressing seat surface portion constituted by a connection head portion disposed in an end portion of the branch pipe into contact and engaging therewith, and a joint metal fitting surrounding an outer peripheral portion of the main pipe rail and a nut previously assembled in the branch pipe end which are meshed with each other so as to be pressed under a neck portion of the connection head portion, thereby being fastened and connected, in which a pressing force is applied to an inner peripheral surface of the branch hole by a diameter expansion method which applies a pressure to a pipe diametrical direction from an inner portion of the branch hole, thereby generating a compression residual stress at a portion near the open end portion of the communication passage of the main pipe rail in the branch hole.

Still further, in accordance with a seventh aspect of the invention, there is provided a method of manufacturing a common rail comprising at least one branch hole provided in an axial peripheral wall portion of a main pipe rail having a communication passage inside an axial core, a pressure receiving seat surface communicating with a branch pipe having a communication passage communicating with the communication passage in a peripheral surface portion of the branch hole and open to an outer portion, thereby bringing a pressing seat surface portion constituted by a connection head portion disposed in an end portion of the branch pipe into contact and engaging therewith, and a joint metal fitting surrounding an outer peripheral portion of the main pipe rail and a nut previously assembled in the branch pipe end which are meshed with each other so as to be pressed under a neck portion of the connection head portion, thereby being fastened and connected, in which a piece-like body formed in a spherical body or having a tapered front end is pressed to an open end portion of the communication passage of the main pipe rail of the branch hole, thereby generating a compression residual stress at a portion near the open end portion of the communication passage of the main pipe rail in the branch hole.

Accordingly, in accordance with the invention, by remaining a compression residual stress at a portion near the open end portion of the communication passage of the main pipe rail in the branch hole, a tensile stress generated in an inner peripheral edge portion P of the lower end of the branch hole by an axial force applied to the pressure receiving seat surface together with an internal pressure of the main pipe rail and a pressing by the connection head portion of the branch pipe is canceled by the compression residual stress, thereby reducing a maximum tensile stress value generated in the inner peripheral edge portion of the lower end of the branch hole. As a method of generating and remaining a compression residual stress at a portion near the open end portion of the communication passage of the main pipe rail in the branch hole, the following methods are used, (1) a method of applying a pressing force to the main pipe rail from an outer portion in a diametrical direction by a press method, (2) a method of applying a pressure within the communication passage of the main pipe rail, (3) a pipe expansion method of applying a pressure from the inner portion of the main pipe rail in a pipe expanding direction, (4) a diameter expansion method of applying a pressure from the inner portion of the branch hole in a diametrical direction, and (5) a method of pressing a piece-like body formed in a spherical body or having a tapered front end to the open end portion of the communication passage of the main pipe rail in the branch hole.

In this case, the press method for generating a compression residual stress at a portion near the open end portion of the communication passage of the main pipe rail in the branch hole is performed before or after or at the same time of punching the branch hole, the communication passage internal pressure pipe expansion method may be performed before or after punching the branch hole, however, is preferably performed after punching the branch hole, and the branch hole diameter expansion method is performed after punching the branch hole.

In accordance with the invention, as (1) the method of applying a pressing force from the outer portion of the main pipe rail by a press method, for example, a method of pressing by a punch or a rod in a state of mounting the rail body on a female mold having a circular arc groove and pressing and fixing by right and left movable molds can be used.

Further, as (2) the method of applying a pressure within the communication passage of the main pipe rail, it is preferable to use a hydraulic pressure such as an oil pressure or a water pressure.

Next, as (3) the pipe expansion method of applying a pressing force from the inner portion of the main pipe rail to the pipe diametrical direction, for example, a method of pressure welding by a drawing-out method of a pressing method by means of a diameter expansion device such as a spherical body or a shell-like plug having a diameter slightly larger than an inner diameter of the communication passage within the communication passage of the main pipe rail, or a diameter expansion method by a vanishing tool can be used.

Further, as (4) the method of applying a pressure from the inner portion of the branch hole to a diametrical direction, a method of pressure welding a spherical body or a plug having a diameter slightly larger than an inner diameter of the branch hole by a pressing method can be used.

Still further, as (5) the method of pressing a piece-like body formed in a spherical body or having a tapered front end to the open end portion of the communication passage of the main pipe rail in the branch hole, with using a piece-like body formed in a spherical body or having a front end formed in a tapered conical shape, an oval conical shape or an oblong conical shape, for example, a method of inserting a rigid ball and a rigid ball receiver or a piece-like body having a tapered front end and a piece-like body receiver into the main pipe rail, arranging the rigid ball receiver or the piece-like receiver in such a manner that the spherical surface of the rigid ball or the front conical surface of the piece-like body is brought into contact with the open end portion of the communication passage of the main pipe rail in the branch hole, inserting and pressing a punch having a wedge-like front end from the other end portion of the main pipe rail and pressing the spherical surface of the rigid ball or the front end conical surface of the piece-like body to the open end portion of the communication passage of the main pipe rail in the branch hole can be used.

As mentioned above, in accordance with the invention, by remaining a compression residual stress at the portion near the open end portion of the communication passage of the main pipe rail in the branch hole, the tensile stress generated in the inner peripheral edge portion of the lower end of the branch hole at a time of a high pressure fuel accumulation to the communication passage in a use time can be canceled by a compression residual stress so as to be effectively restricted, thereby improving an internal pressure fatigue strength in the branch pipe connecting portion.

BRIEF DESCRIPTION OF THE DRAWINGS

FIGS. 2A, 2B, 2C, 2D and 2E are views showing pressing force application means in the manufacturing method mentioned above, in which FIG. 2A is a vertical cross sectional view which shows a method of pressing by using a punch having a pressing surface formed in an inverted concave shape in a state of being partially broken, FIG. 2B is a vertical cross sectional view which shows a method of pressing by using a punch having an annular projection provided on an outer peripheral surface of the main pipe rail and a flat pressing surface, FIG. 2C is a vertical cross sectional view which shows a method of pressing by using a punch having an outer peripheral surface of the main pipe rail formed in a concave shape and a pressing surface formed in a spherical surface, FIG. 2D is a vertical cross sectional view which shows a method of pressing by using a punch having an outer peripheral surface of the main pipe rail projected in an angular shape and a pressing surface formed in a flat shape, and FIG. 2E is a vertical cross sectional view which shows a method of pressing by using a punch having a hole with a bottom having the same diameter as that of the branch hole within an outer peripheral surface of the main pipe rail and a projection having a diameter capable of fitting to the hole with the bottom formed on the pressing surface;

FIGS. 8A and 8B are schematic views which show a fifth embodiment of a method of manufacturing a common rail in accordance with the invention, in which FIG. 8A is a vertical cross sectional view of a branch hole which shows a method of pressing the open end portion of the communication passage of the main pipe rail in the branch hole by using a spherical body and FIG. 8B is a vertical cross sectional view of the branch hole which shows a method of pressing the open end portion of the communication passage of the main pipe rail in the branch hole by using a piece-like body having a tapered front end;

FIGS. 9A, 9B, 9C and 9D are schematic views which show a sixth embodiment of a method of manufacturing a common rail in accordance with the invention, in which FIG. 9A is a vertical cross sectional view of the sixth embodiment, FIG. 9B is a cross sectional view on a line b—b in FIG. 9A, FIG. 9C is a cross sectional view on a line c—c in FIG. 9A and FIG. 9D is a cross sectional view on a line d—d in FIG. 9A;

DETAILED DESCRIPTION OF THE PREFERRED EMBODIMENTS

Figure 1:
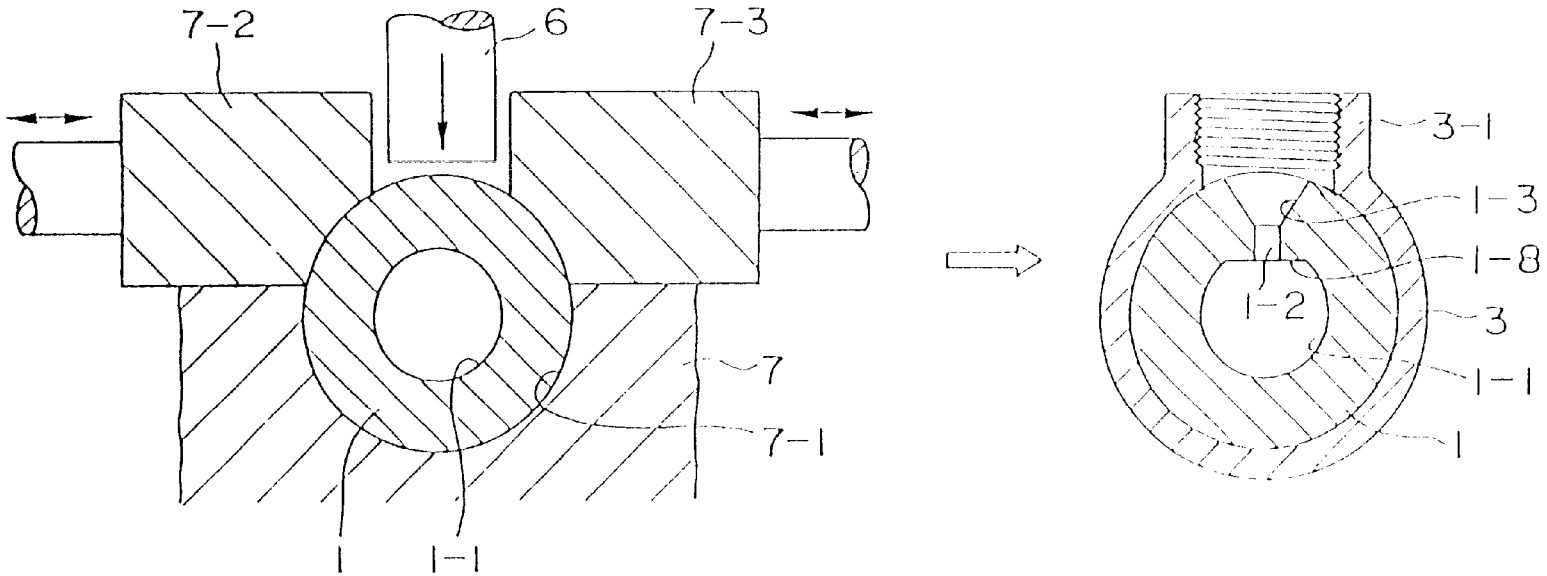
FIG. 1 is a schematic view which shows a first embodiment of a method of manufacturing a common rail in accordance with the invention.

In FIGS. 1 to 10, reference numeral 1 denotes a main pipe rail, reference numeral 2 denotes a branch pipe, reference numeral 3 denotes a ring-like or polygonal joint metal fitting, reference numeral 4 denotes a fastening nut, reference numeral 5 denotes a sleeve washer, reference numeral 6 denotes a punch, reference numeral 7 denotes a metal mold, reference numerals 8-1 and 8-2 denote a diameter expanding device, reference numeral 9 denotes a fixing jig, reference numeral 10 denotes a tension apparatus, reference numeral 11 denotes a pressing apparatus, reference numeral 12 denotes a punch, reference numeral 13 denotes a rigid ball receiver, and reference numeral 13' denotes a piece-like body receiver.

The main pipe rail 1 as a common rail is a high pressure piping steel pipe made of STS480 having relatively thick pipe-like portion, for example, having a diameter of 28 mm and a thickness of 9 mm, and an inner portion of an axial core thereof forms a communication passage 1-1.

In a method shown in FIG. 1 in accordance with the invention, in a state of removing the ring-like or polygonal joint metal fitting 3 having a screw wall 301 meshed with the fastening nut 4 assembled with the branch pipe 2 side on an inner peripheral surface, the main pipe rail 1 is fixed by the metal mold 7 in a press process. The mold 7 is constituted by a metal mold having a concave cross section including a curved surface 7-1 having substantially the same radius of curvature as the peripheral surface of the main pipe rail 1, as shown in the drawing, and substantially lower half periphery of the main pipe rail 1 is fixed to the metal mold 7. Next, left and right movable metal molds 7-2 and 7-3 are activated by an actuator so as to hold an upper half periphery of the main pipe rail 1 except a portion near the portion in which the branch hole 1-2 is formed from both sides. This is necessary for sufficiently obtaining an effect by the press.

When the main pipe rail 1 is fixed to the metal mold 7, a pressing force is applied to an outer peripheral surface of the main pipe rail 1 toward an inner diameter in a diametrical direction on a central axis line of the main pipe rail 1 by the punch 6 mounted to a press apparatus (not shown) and having a diameter smaller than an inner diameter of the communication passage 1-1. As the pressing force at this time, although it is not specifically limited, it is sufficient to set a degree that the inner peripheral surface of the main pipe rail communication passage 1-1 positioned immediately below the punch 6 slightly projects so that a flat portion 1-8 is formed. Due to the pressing force by the punch 6, as well as the inner peripheral surface of the main pipe rail communication passage 1-1 slightly projects so as to be flattened, a plastically deformed portion and an elastically deformed portion are produced at a time of applying the pressing force, and a compression residual stress is generated due to a deformation generated by a difference of a return amount at a time of removing the pressing force.

Continuously, in a finish working process, the branch hole 1-2 is formed in the portion deformed in the pressing process of the main pipe rail 1, preferably on the center axis line pressed by the punch 6 in such a manner as to make the circular and outward open peripheral surface communicating with the communication passage 1-1 of the main pipe rail 1 and communicating with the communication passage a pressure receiving surface 1-3. Thereafter, the ring-like or polygonal joint metal fitting 3 is mounted.

Figure 2:
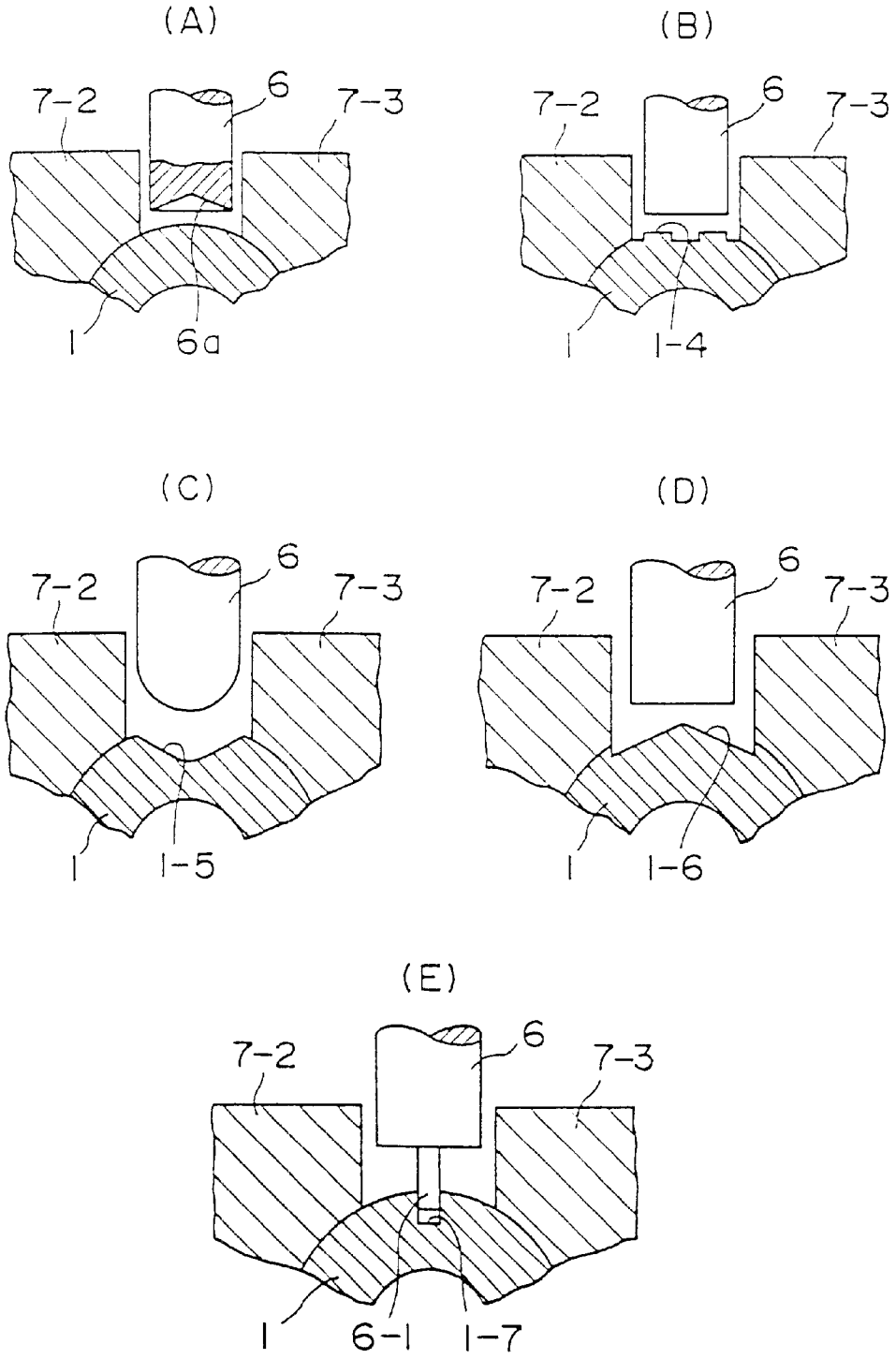

FIG. 2 exemplifies pressing force application means by a press method for remaining a compression residual stress near the open end portion of the communication passage of the main pipe rail in the branch hole 1-2, in which FIG. 2A shows a method of forming a concave portion 6*a* having a triangular cross section in a front end portion (a pressing surface) of the punch 6 and applying a pressing force to the outer peripheral surface of the main pipe rail 1 by the punch 6. In the case of this method, since a great pressing force is applied to the peripheral portion in addition to the center portion of the outer peripheral surface of the main pipe rail surrounded by the screw wall 3-1, a compression residual stress can be effectively remained in a relatively wide range near the branch hole 1-2 provided in the portion.

Further, FIG. 2B shows a method of remaining a compression residual stress in a relatively wide range near the branch hole 1-2 which is later provided in the same manner as that of FIG. 2A by providing an annular projection 1-4 on the outer peripheral surface of the main pipe rail 1 surrounded by the screw wall 3-1 and pressing an upper surface of the annular projection 1-4 by the punch 6 having a flat pressing surface.

FIG. 2C shows a method of forming the outer peripheral surface of the main pipe rail 1 surrounded by the screw wall 3-1 in a concave portion 1-5 having an inverted triangular cross sectional shape and pressing a bottom portion constituted by the concave portion 1-5 by the punch 6 having a spherical pressing surface. In this method, since an inclined surface of the bottom portion is first pressed, in this case, a compression residual stress is effectively remained near the branch hole 1-2 which is later provided.

FIG. 2D shows a method of providing a projection 1-6 having an angular cross sectional shape on the outer peripheral surface of the main pipe rail 1 surrounded by the screw wall 3-1 and pressing the bottom portion constituted by the projection 1-6 by the punch 6 having a flat pressing surface. In this method, since the projection 1-6 having an angular cross section is first pressed by the punch 6, a great pressing force is applied to the center portion of the bottom portion. Accordingly, also in this case, a great compression residual stress is remained near the branch hole 1-2 which is later provided in a concentrated manner.

FIG. 2E shows a method of providing a hole with a bottom 1-7 having an appropriate depth and the same diameter as that of the branch hole 1-2 later provided in the center of the outer peripheral surface of the main pipe rail 1 surrounded by the screw wall 3-1 and pressing the projection 6-1 having a diameter capable of fitting to the hole with a bottom 1-7 and a length slightly longer than a depth of the hole with a bottom by the punch 6 provided on the pressing surface. In the case of this method, since the peripheral portion of the hole with a bottom 1-7 is pressed at the same time as the hole with a bottom 1-7 is pressed by the projection 6-1, the pressing force is applied to the portion of the branch hole 1-2 later provided in a concentrated manner and a compression residual stress is necessarily remained near the branch hole 1-2. In this case, a shape of the punch and a shape formed on the outer peripheral surface of the main pipe rail in opposite to the front end of the punch are not limited to combinations of the shapes shown in FIGS. 2A to 2E.

As a method of applying a pressing force by a press method and generating a compression residual stress in accordance with the invention, not only the method mentioned above but also a method shown in FIG. 3 can be employed.

Figure 3:
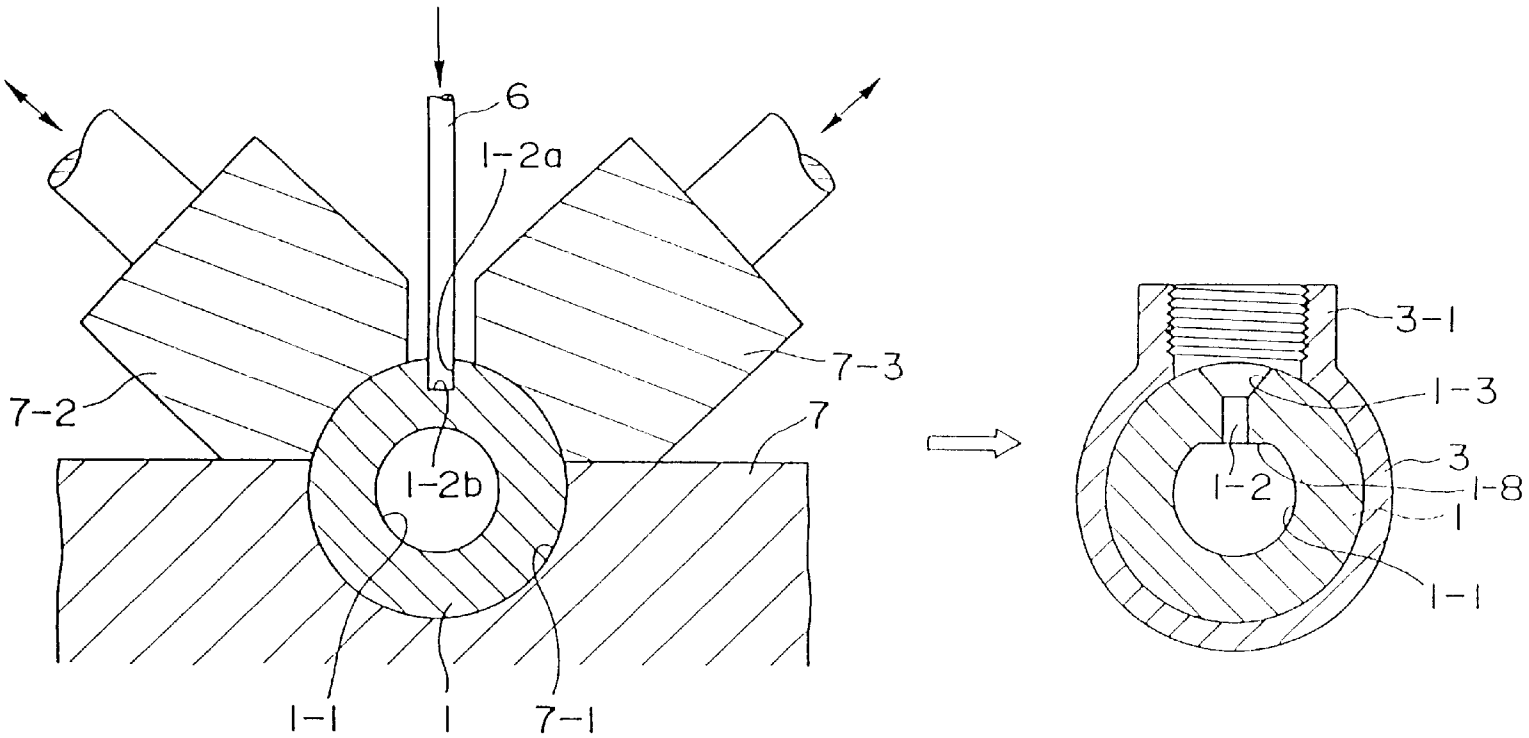
FIG. 3 is a schematic view which shows a modified embodiment of the manufacturing method shown in FIG. 1.

In FIG. 3, the structure is made such as to provide a hole with a bottom 1-2*a* having an appropriate depth and substantially the same diameter as that of the branch hole 1-2 having a predetermined hole diameter which is later provided and to press an inner bottom portion 1-2*b* of the hole with a bottom 1-2*a* to a diametrical direction by the punch 6 having a diameter capable of fitting to the hole with a bottom 1-2*a* and a length larger than a depth of the hole with a bottom. Since the inner bottom portion 1-2*b* is pressed by the punch 6, the pressing force is applied to the portion of the branch hole 1-2 later provided in a concentrated manner and a compression residual stress is necessarily remained also near the branch hole 1-2.

Thereafter, the hole with a bottom 1-2*a* is extended to the communication passage 1-1 by a cutting process by means of a drill, thereby forming the branch hole 1-2. Next, the pressure receiving seat surface 1-3 is formed in the circular and outward open peripheral surface.

Figure 4:
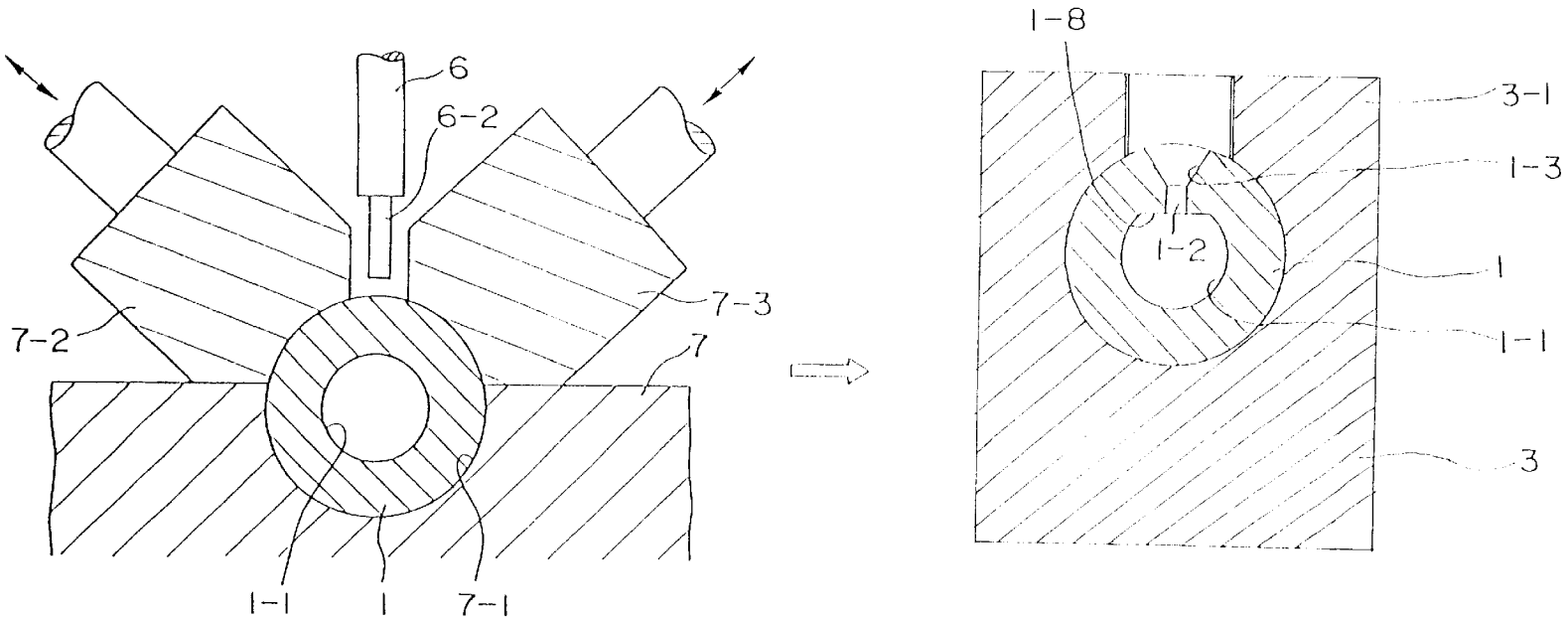
FIG. 4 is a schematic view which shows an embodiment of a method of punching a branch hole at the same time of applying a pressing force in the manufacturing method in accordance with the first embodiment of the invention.

Further, a method shown in FIG. 4 exemplifies a method of punching the branch hole at the same time of applying a pressing force in the manufacturing method in accordance with the first embodiment, which corresponds to a method of punching the branch hole 1-2 with pressing the outer peripheral surface of the main pipe rail 1 by using the punch 6 provided with a projection 6-2 having a length longer than a thickness of the main pipe rail 1 and the same diameter as that of the branch hole 1-2 in the front end. In this case, since the outer peripheral surface of the main pipe rail 1 is pressed by the projection 6-2, the pressing force is applied to the portion of the branch hole 1-2 simultaneously punched in a concentrated manner, and a compression residual stress is necessarily generated near the branch hole 1-2. The metal fitting shown by FIG. 4 has a polygonal shape.

Still further, as a method of applying a pressing force by a press method by means of a punch and generating a compression residual stress, the pressing force is not always applied to the center of the branch hole, but it is possible to apply the pressing force with slightly shifted from the portion in which the branch hole is formed and concentrate a compression residual stress to at least a part of the branch hole, that is, mainly to an inner peripheral edge portion P in the axial direction of the main pipe rail in the lower end of the branch hole which becomes a starting point of a crack, thereby generating and remaining a compression residual stress.

Figure 5:
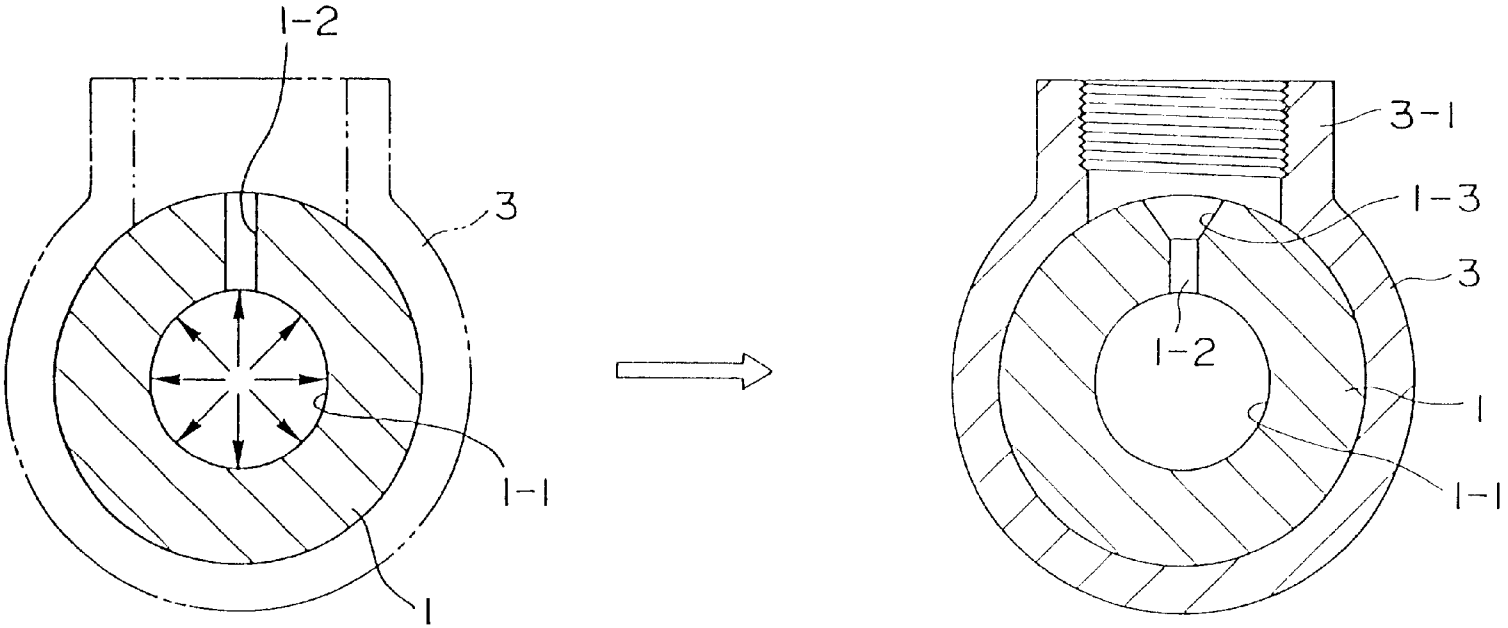
FIG. 5 is a schematic view which shows a second embodiment of a method of manufacturing a common rail in accordance with the invention.

A method shown in FIG. 5 corresponds to a case that an internal pressure method of applying a pressure within the communication passage 1-1 of the main pipe rail 1 is employed as means for generating a compression residual stress near the open end portion of the communication passage 1-1 of the main pipe rail in the branch hole 1-2. This method corresponds to a method of generating and remaining a compression residual stress near the open end portion of the communication passage of the main pipe rail in the branch hole 1-2 by a method of applying a high pressure by which at least 25%, preferably 50 to 75% of a thickness of the main pipe rail 1 is yielded from the inner peripheral surface side of the thickness of the main pipe rail 1 by feeding a liquid fluid such as a water or an oil within the rail in a state of sealing one side of the main pipe rail 1.

In this case, a working of the branch hole 1-2 is preferably performed before applying the internal pressure since a compression stress is securely remained, and further, the ring-like or polygonal joint metal fitting 3 is mounted after generating a compression residual stress near the open end portion of the communication passage of the main pipe rail.

Figure 6:
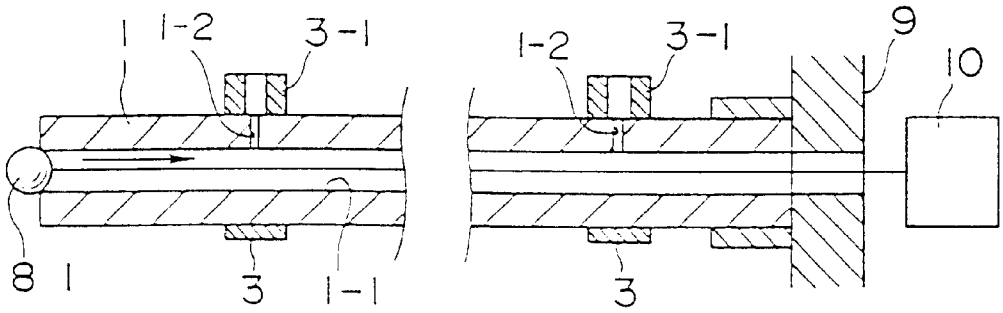
FIG. 6 is a schematic view which shows a third embodiment of a method of manufacturing a common rail in accordance with the invention.

A method shown in FIG. 6 corresponds to a case that a pipe expansion method of applying a pressing force to a pipe diametrical direction from the inner portion of the main pipe rail 1 is employed as means for generating a compression residual stress near the open end portion of the communication passage 1-1 of the main pipe rail in the branch hole 1-2. The method corresponds to a method of expanding the communication passage 1-1 of the main pipe rail by a method of drawing a diameter expansion device 8-1 having a diameter slightly larger than the inner diameter of the communication passage 1-1 such as a spherical body, a plug and a roller vanishing tool by a tension apparatus 10 so as to move within the communication passage 1-1 with being in press contact in a state of horizontally fixing the main pipe rail 1 to a fixing jig 9, and generating and remaining a compression residual stress near the open end portion of the communication passage of the main pipe rail in the branch hole 1-2.

In this case, when the branch hole 1-2 is punched before a diameter expanding operation against the inner peripheral surface of the main pipe rail 1, it is preferable since the compression stress is securely remained near the open end portion of the branch hole 1-2.

Figure 7:
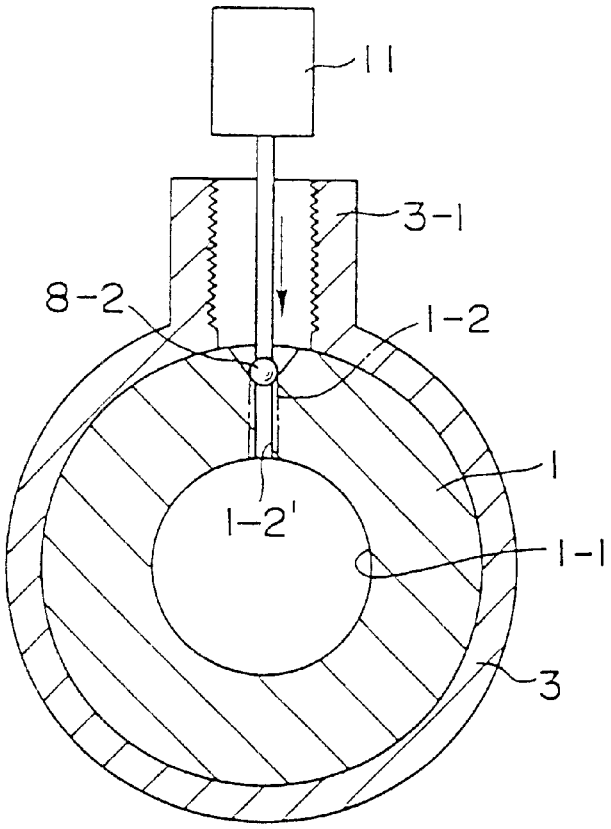
FIG. 7 is a schematic view which shows a fourth embodiment of a method of manufacturing a common rail in accordance with the invention.
Figure 8:
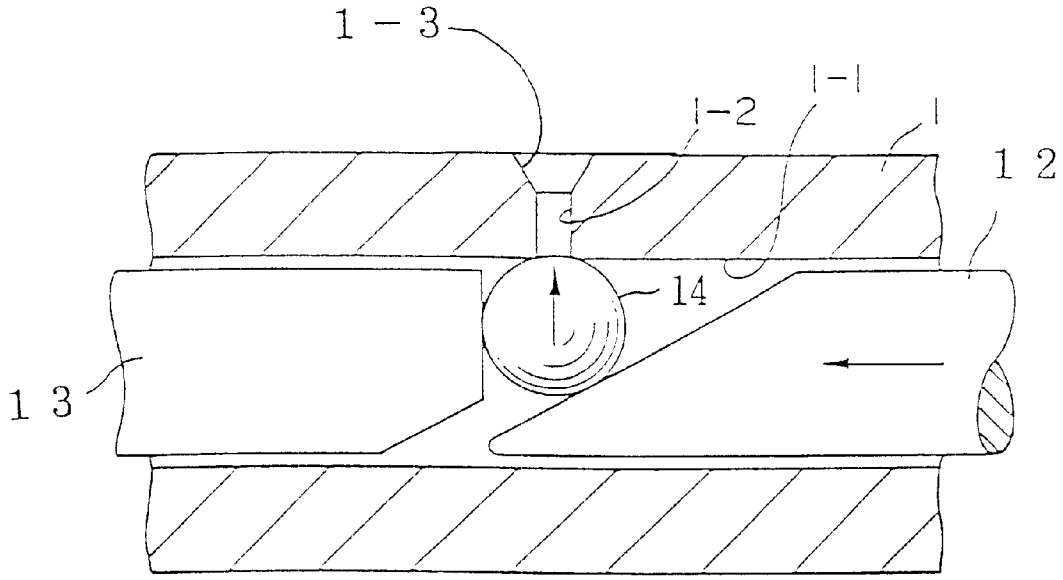
Figure 8:
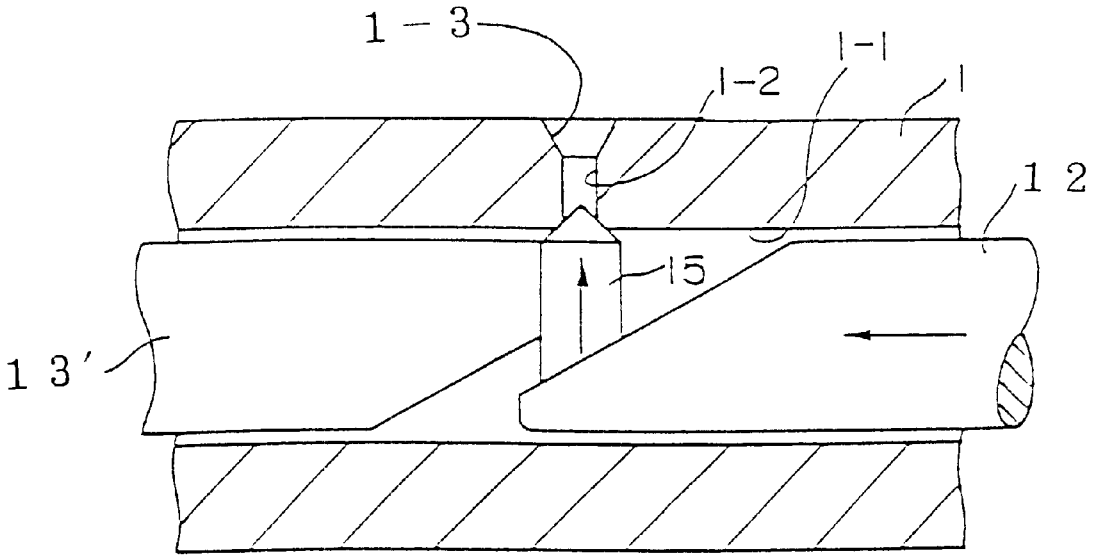

A method shown in FIG. 7 corresponds to a method of punching a branch hole 1-2' having a diamter slightly smaller than a predetermined hole diameter on the main pipe rail in a finish work process, expanding the branch hole 1-2' by a method of pressing a diameter expansion device 8-2 having substantially the same diameter as the inner diameter of the branch hole 1-2 having a predetermined hole diameter such as a spherical body or a plug into the branch hole 1-2' having the small diamter by means of a pressing apparatus 11, and generating and remaining a compression residual stress near the open end portion of the communication passage of the main pipe rail in the branch hole 1-2, as means for generating a compression residual stress near the open end portion of the communication passage 1-1 of the main pipe rail in the branch hole 1-2.

A method shown in FIG. 8A exemplifies a method of generating a compression residual stress in the open end portion of the communication passage of the main pipe rail in the branch hole 1-2 by using a rigid ball. In this method, a rigid ball 14 and a rod-like rigid ball receiver 13 are inserted into the main pipe rail 1, the rigid ball receiver 13 is disposed in such a manner that a spherical surface of the rigid ball 14 is brought into contact with the open end portion of the communication passage of the main pipe rail in the branch hole 1-2, and a punch 12 having a front end portion formed in a wedge shape is inserted from the other end portion of the main pipe rail, thereby mounting the rigid ball 14 on the inclined slide surface in the front end portion. In this state, when the punch 12 is pressed, a force in a direction of the branch hole is applied to the rigid ball 14 due to a wedge effect by the punch 12, so that the rigid ball 14 is pressed to the open end portion of the communication passage of the main pipe rail in the branch hole 1-2.

Then, a load is applied by pressing the punch 12 until reaching to a necessary pressure, thereby strongly pressing the rigid ball 14 to the open end portion of the communication passage of the main pipe rail, and thereafter, the rigid ball 14, the rigid ball receiver 13 and the punch 12 are removed from the main pipe rail 1. In the case of this method, since a pressing force is applied to the open end portion of the communication passage of the main pipe rail in the branch hole 1-2 by the rigid ball 14 pressed by the punch 12, a compression residual stress can be effectively generated and remained near the open end portion of the communication passage of the main pipe rail in the branch hole 1-2.

A method shown in FIG. 8B exemplifies a method of generating a compression residual stress in the open end portion of the communication passage of the main pipe rail in the branch hole 1-2 by using a piece-like body 15 having a front end formed in a conical shape in place of the rigid ball 14. In this method, in accordance with the same operation order as that shown in FIG. 8A, a piece-like body 15 and a piece-like body receiver 13' are inserted into the main pipe rail 1, the piece-like body receiver 13' is disposed in such a manner that a conical surface of the piece-like body 15 is brought into contact with the open end portion of the communication passage of the main pipe rail in the branch hole 1-2, and the punch 12 having a front end portion formed in a wedge shape is inserted from the other end portion of the main pipe rail, thereby mounting the piece-like body 15 on the inclined slide surface of the front end portion. In this state, when the punch 12 is pressed, a force in a direction of the branch hole is applied to the piece-like body 15 due to a wedge effect by the front end portion of the punch 12 in the same manner as that of the rigid ball case mentioned above, so that the piece-like body 15 is pressed to the open end portion of the communication passage of the main pipe rail in the branch hole 1-2. Then, a load is applied by pressing the punch 12 until reaching to a necessary pressure, thereby strongly pressing the piece-like body 15 to the open end portion of the communication passage of the main pipe rail, and thereafter, the piece-like body, the piece-like body receiver 13' and the punch 12 are removed from the main pipe rail 1. Accordingly, in accordance with this method, since a pressing force is applied to the open end portion of the communication passage of the main pipe rail in the branch hole 1-2 by the piece-like body 15 pressed by the punch 12, a compression residual stress can be effectively generated and remained near the open end portion of the communication passage of the main pipe rail in the branch hole 1-2, in the same manner as that of the rigid ball.

Figure 9:
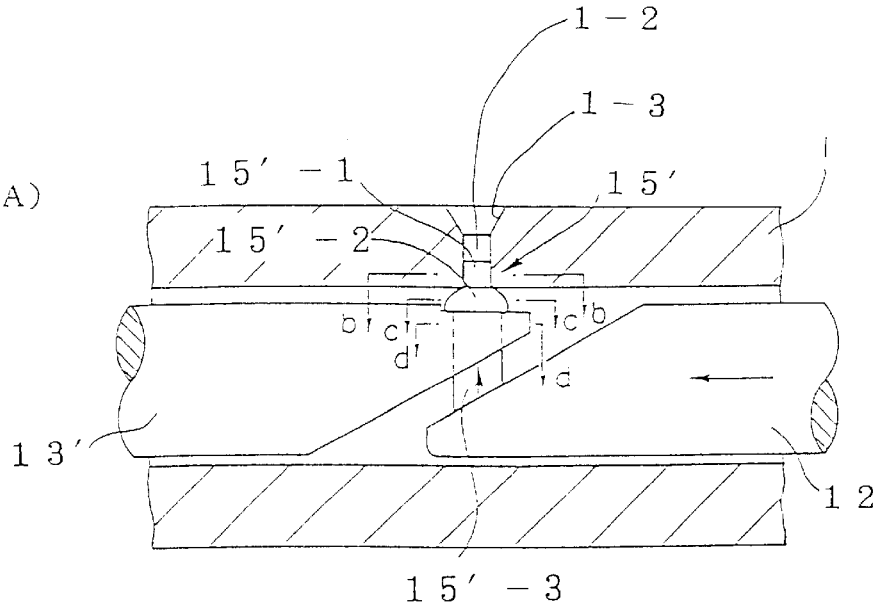
Figure 9:
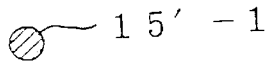
Figure 9:
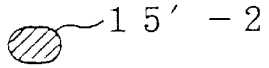
Figure 9:
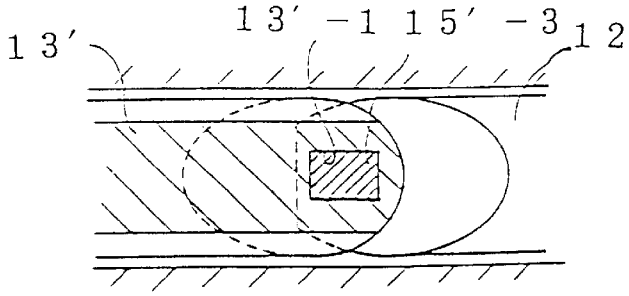

It is preferable to use a piece-like body 15' having a structure shown in FIG. 9 in place of the piece-like body 15 shown in FIG. 8B. The piece-like body 15' shown in FIG. 9 is constituted by an integral combination of a front end portion 15'-1 having a circular cross section, a pressing portion 15'-2 having an oblong cross section and a base portion 15'-3 having a rectangular cross section. The front end portion 15'-1 having a circular cross section has a circular cross sectional shape substantially aligned with an inner diameter of the branch hole 1-2 for being guided to the branch hole 1-2 so as to accurately position the piece-like body 15'. Further, the pressing portion 15'-2 having an oblong cross section has an oblong cross sectional shape making a longitudinal direction of the communication passage 1-1 a long line for concentrically pressing both sides of the main pipe rail 1 of the lower end inner peripheral edge portion in the branch hole 1-2 in which a great tensile stress is easily generated among the open end portion of the communication passage of the main pipe rail. Still further, the base portion 15'-3 having a rectangular cross section has a rectangular cross sectional shape for securing a directivity of the piece-like body 15' by fitting to a rectangular hole 13'-1 provided in the front end portion of the piece-like body receiver 13'.

An operation order for effectively generating and remaining a compression residual stress near the open end portion of the communication passage of the main pipe rail in accordance with the method shown in FIG. 9 is the same as the manner as that shown in FIG. 9.

Here, in the case of applying a pressing force to the main pipe rail 1 by a pressing method by means of the press method, the internal pressure method, the pipe expansion method, the spherical body or the piece-like body having the tapered front end as the means for generating a compression residual stress near the open end portion of the communication passage of the main pipe rail in the branch hole, the embodiment in a stat that the ring-like or polygonal joint metal fitting 3 is removed is shown in any of the cases, however, it is needless to say that application of the pressing force to the main pipe rail 1 can be performed in a state of mounting the ring-like or polygonal joint metal fitting 3.

Figure 10:
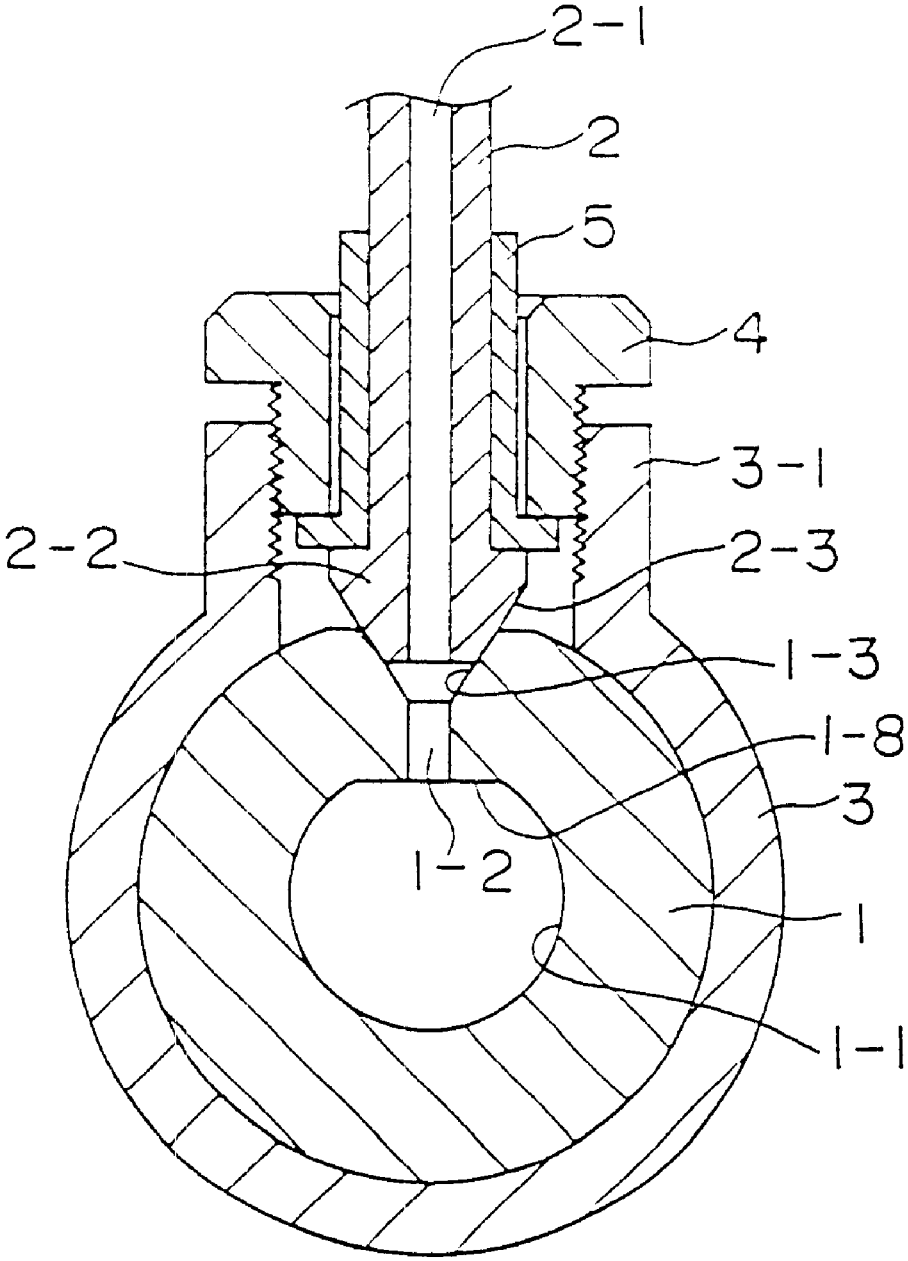
FIG. 10 is a vertical cross sectional view which shows an embodiment of a branch pipe connecting structure portion of the common rail manufactured by the manufacturing method in accordance with the invention.
Figure 11:
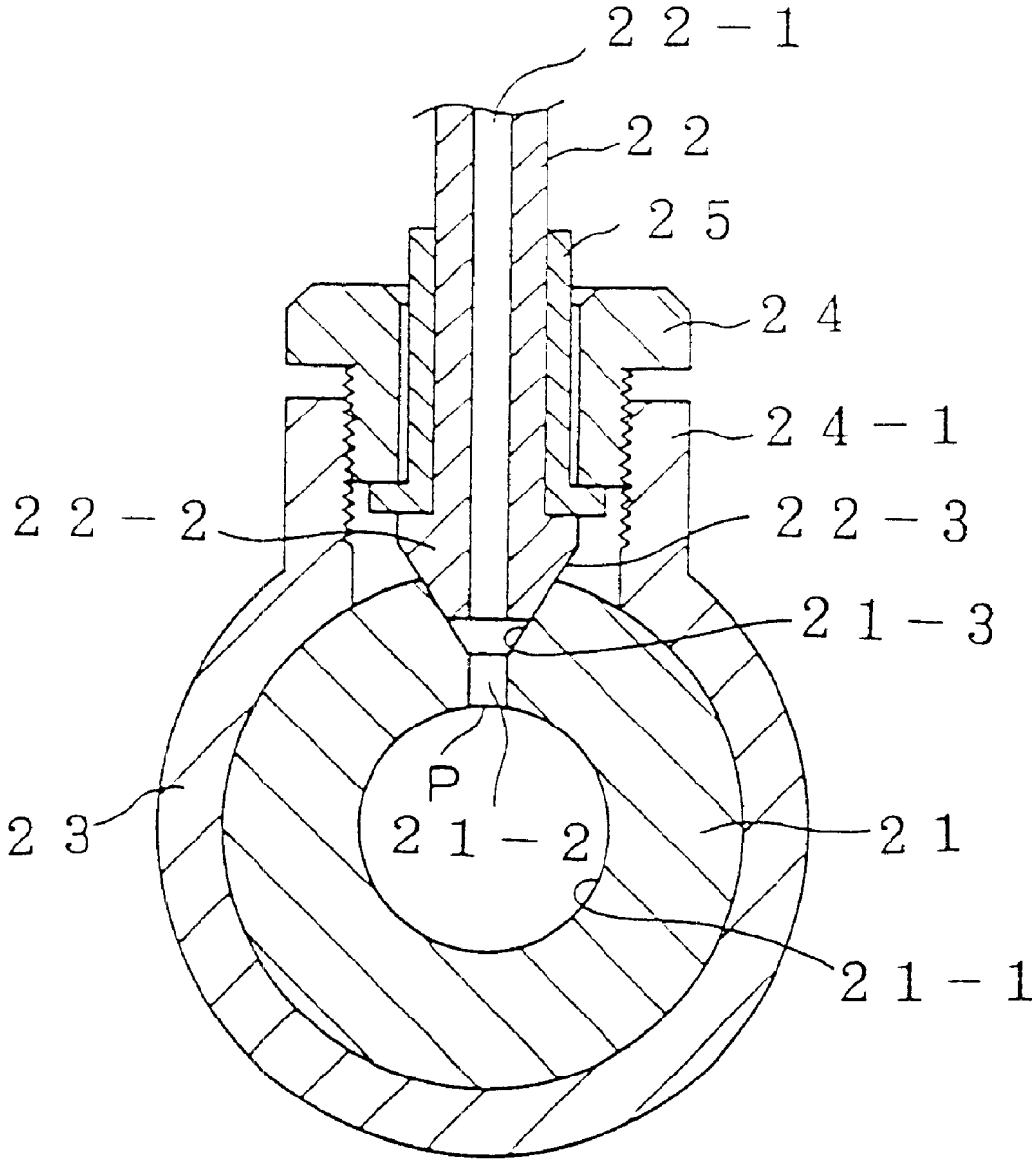
FIG. 11 is a vertical cross sectional view which shows a branch connecting structure portion of the conventional common rail which is a subject of the invention.

On the contrary, the branch pipe 2 is constituted by a branching pipe or a branch metal fitting, has the flow passage 2-1 communicating with the communication passage 1-1 of the main pipe rail 1 therewithin, and is provided with a pressing seat surface 2-3 constituted by the connection head portion 2-2 expanded by a buckling formation and having a conical front end in the end portion thereof, and the connection structure thereof is made in the same manner as that of the conventional manner, as shown in FIG. 10. Accordingly, the branch pipe 2 is fastened and connected together with a pressing of the fastening nut 4 under the neck of the connection head portion 2-2 by bringing the pressing seat surface 2-3 constituted by the connection head portion 2-2 close to the branch pipe 2 into contact with the pressure receiving surface 1-3 close to the main pipe rail 1, and by meshing the fastening nut 4 previously assembled in the branch pipe through the sleeve washer 5 with the screw wall 3-1 of the ring-like or polygonal joint metal fitting 3.

As mentioned above, in accordance with the invention, a pressing force is applied to the portion near the center of the mounting portion of the screw wall 3-1 of the joint metal fitting 3 of the main pipe rail 1 and the branch hole 1-2 communicating with the communication passage 1-1 of the main pipe rail 1 and having the pressure receiving seat surface 1-3 is formed in the corresponding portion. Since a compression residual stress is generated and remained near the open end portion of the communication passage of the main pipe rail in the branch pipe 1-2 by the pressure application process preferably together with forming the flat portion 1-8, a tensile stress generated in the lower end inner peripheral edge portion P of the branch hole 1-2 due to an axial force applied to the pressure receiving seat surface 1-3 can be widely reduced by a canceling effect of the compression residual stress together with the internal pressure of the main pipe rail 1 and the pressing of the connection head portion 2-2 of the branch pipe 2. Further, since the inner peripheral surface of the communication passage 1-1 of the main pipe rail near the branch hole 1-2 is slightly projected and flattened due to a pressure application by the press so as to form the flat portion 1-8, the tensile stress generated in the branch hole 1-2 portion can be canceled by the compression residual stress so as to be reduced. Accordingly, the common rail obtained by the method in accordance with the invention can further reduce the tensile stress generated in the lower end inner peripheral edge portion P of the branch hole 1-2 due to the compression residual stress and the flattening effect.

As mentioned above, since the common rail in accordance with the invention can cancel the generation of the tensile stress in the lower end inner peripheral edge portion of the branch hole by the compression residual stress so as to effectively restrict the tensile stress, and can improve the internal pressure fatigue strength in the branch pipe connecting portion, the common rail has excellent effect that a secure and stable function can be obtained by having an excellent durability and preventing a fluid leakage due to a generation of the crack generation. Further, in accordance with the method of manufacturing the common rail of the invention, since a pressure application process by the press is only added to the normal manufacturing process and no complex equipment is required, there is no problem that an equipment cost is increased by an increase of the process and a productivity is reduced, so that a great effect that a common rail having a high quality can be provided by a low cost can be obtained.

What is claimed is:

1. An elongate common rail having a peripheral wall, said peripheral wall having an outer surface extending along the common rail and a communication passage extending longitudinally through the common rail, the communication passage defining an inner peripheral surface, at least one branch hole extending through the peripheral wall from the outer surface to the inner peripheral surface, portions of said branch hole adjacent said outer surface being outwardly flared and defining a pressure-receiving seat surface for communication with a branch pipe, portions of said inner peripheral surface at locations spaced from said branch hole being substantially cylindrical, portions of said inner peripheral surface of said peripheral wall of said common rail adjacent and surrounding said branch hole being deformed to define a non-cylindrical surface region surrounding said branch hole with a compression residual stress existing in said common rail adjacent the portions of said inner peripheral surface surrounding said branch hole for improving internal pressure fatigue strength.

2. A common rail according to claim 1, further comprising a branch pipe having an enlarged compression head at one end, said compression head defining a pressing seat surface configured for engagement against the pressure receiving seat surface of said branch hole, a branch communication passage extending through the branch pipe and communicating with the communication passage of the common rail.

3. The common rail of claim 2, further comprising a joint metal fitting having an array of threads substantially concentric with the branch hole and projecting radially beyond the outer peripheral surface of the common rail, a nut assembled onto said branch pipe and threadedly engaging said threads of said joint metal fitting for urging the pressing seat surface portion of the branch pipe tightly against the pressure receiving seat surface of the branch hole of the common rail.

4. The common rail of claim 1, wherein portions of said inner cylindrical surface surrounding said branch hole are substantially flat.

* * * * *